US011036178B1

(12) United States Patent
Otsuka

(10) Patent No.: US 11,036,178 B1
(45) Date of Patent: Jun. 15, 2021

(54) EXPOSURE DEVICE OF IMAGE FORMING APPARATUS

(71) Applicant: TOSHIBA TEC KABUSHIKI KAISHA, Tokyo (JP)

(72) Inventor: Takuya Otsuka, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/784,275

(22) Filed: Feb. 7, 2020

(51) Int. Cl.

| | |
|---|---|
| ***B41J 2/45*** | (2006.01) |
| ***G03G 21/16*** | (2006.01) |
| ***G03G 15/04*** | (2006.01) |

(52) U.S. Cl.
CPC ..... *G03G 21/1666* (2013.01); *B41J 2/45* (2013.01); *G03G 15/04054* (2013.01); *G03G 21/1647* (2013.01); *G03G 2215/0409* (2013.01)

(58) Field of Classification Search
None
See application file for complete search history.

(56) References Cited

U.S. PATENT DOCUMENTS

| | | | | |
|---|---|---|---|---|
| 4,905,028 | A | 2/1990 | Okubo et al. | |
| 2014/0320834 | A1 | 10/2014 | Mikami et al. | |
| 2018/0091691 | A1* | 3/2018 | Kida | H04N 1/0306 |
| 2018/0364610 | A1* | 12/2018 | Okada | G03G 15/04036 |

FOREIGN PATENT DOCUMENTS

| | | |
|---|---|---|
| JP | 2008-209862 | 9/2008 |
| JP | 2011-025631 | 2/2011 |
| JP | 2019-010755 | 1/2019 |
| JP | 2019-168505 | 10/2019 |

OTHER PUBLICATIONS

Extended European Search Report for European Patent Application No. 20204064.8 dated Feb. 24, 2021.

* cited by examiner

*Primary Examiner* — Erica S Lin
(74) *Attorney, Agent, or Firm* — Amin, Turocy & Watson, LLP

(57) ABSTRACT

According to one embodiment, there is provided an exposure device including a print head that exposes photoreceptor to form a latent image on the photoreceptor, a lifting mechanism that lifts or lowers the print head relative to the photoreceptor, and a biasing member that biases the print head toward the photoreceptor. The lifting mechanism has a lifting holder that holds the print head and is liftable with respect to the photoreceptor. The biasing member is provided between the print head and the lifting holder.

17 Claims, 9 Drawing Sheets

EXPOSURE DEVICE OF IMAGE FORMING APPARATUS

FIELD

Embodiments described herein relate to an exposure device of an image forming apparatus.

BACKGROUND

In some exposure devices used in image forming apparatuses such as an electrophotographic apparatus, a print head such as an LED print head (LPH) is used. In such an exposure device, a technique for determining a focal position of a print head with respect to a photoreceptor drum using a gap spacer is known. In this technique, the following configuration is adopted. A gap spacer for providing a focal length is provided between the photoreceptor drum and the print head. In addition, a positioning unit that abuts on the gap spacer is provided on the print head side. Further, a coil spring is provided between the print head and a print head holding unit. The position of the print head is determined with respect to the photoreceptor drum in a state in which the print head receives a predetermined abutting load by causing the gap spacer and the positioning portion to abut on each other and compressing the coil spring.

DETAILED DESCRIPTION

According to one embodiment, there is provided an exposure device including: a print head that exposes a photoreceptor to form a latent image on the photoreceptor; a lifting mechanism that lifts or lowers the print head relative to the photoreceptor; and a biasing member that biases the print head toward the photoreceptor. The lifting mechanism has a lifting holder that holds the print head and is liftable with respect to the photoreceptor. The biasing member is provided between the print head and the lifting holder.

Figure 1:
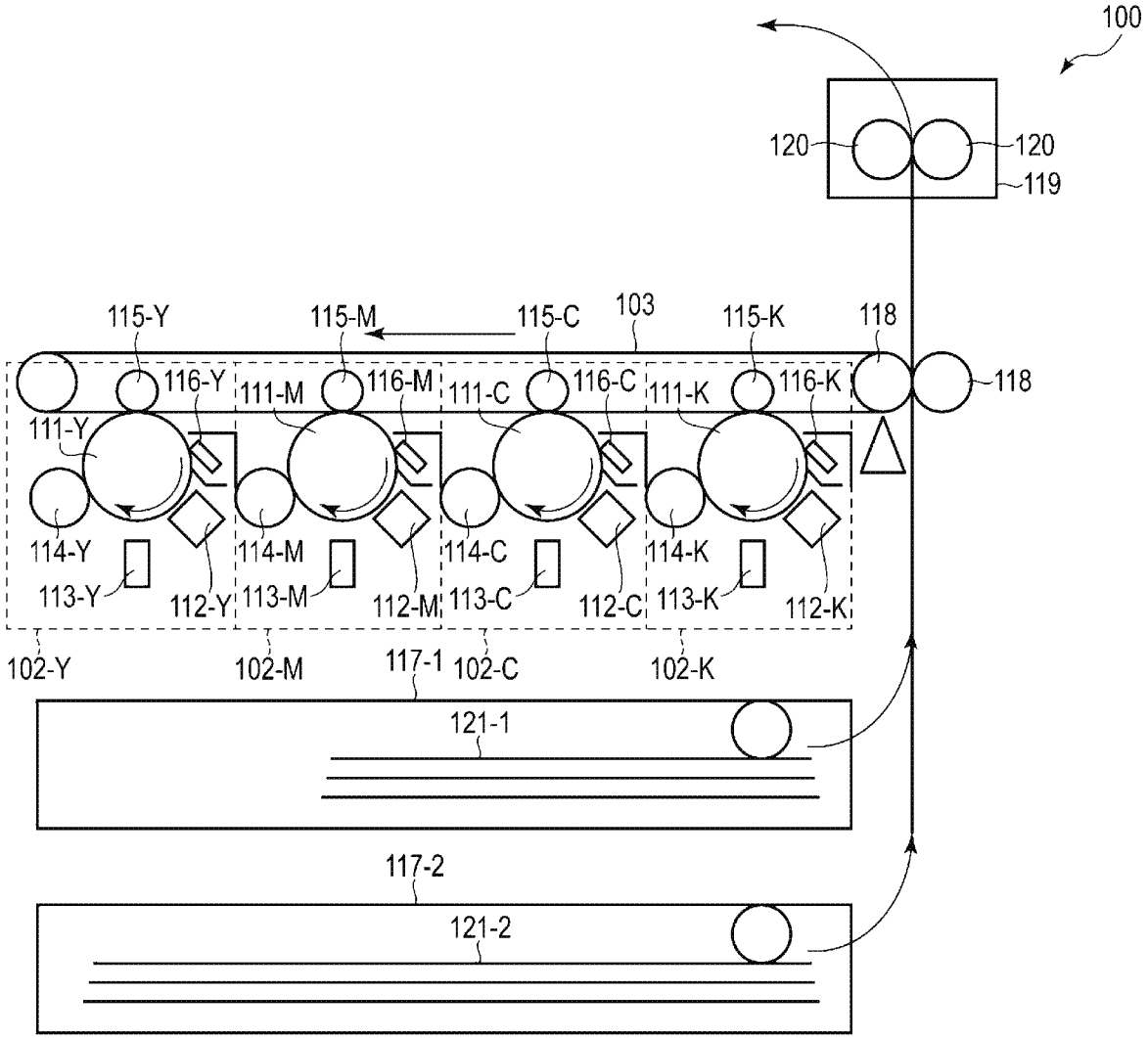
FIG. 1 is a view showing an image forming apparatus according to an embodiment.

FIG. 1 shows an image forming apparatus 100 according to an embodiment. The image forming apparatus 100 is a quadruple tandem type color image forming apparatus. The image forming apparatus 100 is an image forming apparatus such as a printer, a copy machine, or a multifunction peripheral.

The image forming apparatus 100 includes an image forming unit 102-Y that forms a yellow (Y) image, an image forming unit 102-M that forms a magenta (M) image, an image forming unit 102-C that forms a cyan (C) image, and an image forming unit 102-K that forms a black (K) image. The image forming units 102-Y, 102-M, 102-C, and 102-K form yellow, cyan, magenta, and black images, respectively, and transfer the images to a transfer belt 103. Thus, a full-color image is formed on the transfer belt 103.

The image forming unit 102-Y includes a charging charger 112-Y, an exposure device 113-Y, a developing device 114-Y, a transfer roller 115-Y, and a cleaner 116-Y around a photoreceptor drum 111-Y. The image forming units 102-M, 102-C, and 102-K have the same configuration.

In FIG. 1, a symbol "–Y" is attached to the configuration of the image forming unit 102-Y that forms a yellow (Y) image. A symbol "–M" is attached to the configuration of the image forming unit 102-M that forms a magenta (M) image. A symbol "–C" is attached to the configuration of the image forming unit 102-C that forms a cyan (C) image. A symbol "–K" is attached to the configuration of the image forming unit 102-K that forms a black (K) image.

The charging chargers 112-Y, 112-M, 112-C, and 112-K uniformly charge the photoreceptor drums 111-Y, 111-M, 111-C, and 111-K, respectively. The exposure devices 113-Y, 113-M, 113-C, and 113-K expose the photoreceptor drums 111-Y, 111-M, 111-C, and 111-K respectively to form latent images on the photoreceptor drums 111-Y, 111-M, 111-C, and 111-K, respectively. The developing device 114-Y attaches (develops) a yellow toner, the developing device 114-M attaches (develops) a magenta toner, the developing device 114-C attaches (develops) a cyan toner, and the developing device 114-K attaches (develops) a black toner to electrostatic latent image portions of the photoreceptor drums 111-Y, 111-M, 111-C, and 111-K, respectively.

The transfer rollers 115-Y, 115-M, 115-C, and 115-K transfer toner images developed on the photoreceptor drums 111-Y, 111-M, 111-C, and 111-K to the transfer belt 103, respectively. The cleaners 116-Y, 116-M, 116-C, and 116-K clean the remaining toner without transfer of the photoreceptor drums 111-Y, 111-M, 111-C, and 111-K, respectively. Thus, the photoreceptor drums 111-Y, 111-M, 111-C, and 111-K enter the standby state for the next image formation.

A paper 121-1 of a first size (small size) is stored in a paper cassette 117-1. A paper 121-2 of the second size (large size) is stored in a paper cassette 117-2.

The toner image is transferred from the transfer belt 103 by a pair of transfer rollers 118 to the paper 121-1 or 121-2 picked up from the paper cassette 117-1 or 117-2. The paper 121-1 or 121-2 onto which the toner image is transferred is heated and pressurized by a fixing roller 120 of a fixing unit 119. The toner image is firmly fixed on the paper 121-1 or 121-2 by heating and pressurizing with the fixing roller 120. By repeating the above process operation, an image forming operation is continuously performed.

Hereinafter, the photoreceptor drums 111-Y, 111-M, 111-C, and 111-K and the exposure devices 113-Y, 113-M, 113-C, and 113-K shown in FIG. 1 will be described. The image forming units 102-Y, 102-M, 102-C, and 102-K are substantially the same structures except for different toner colors. Accordingly, in the following description, the exposure devices 113-Y, 113-M, 113-C, and 113-K are typically represented by the exposure device 113 without being distinguished, and the photoreceptor drums 111-Y, 111-M, 111-C and 111-K are also typically represented by the photoreceptor drum 111 without being distinguished.

Figure 2:
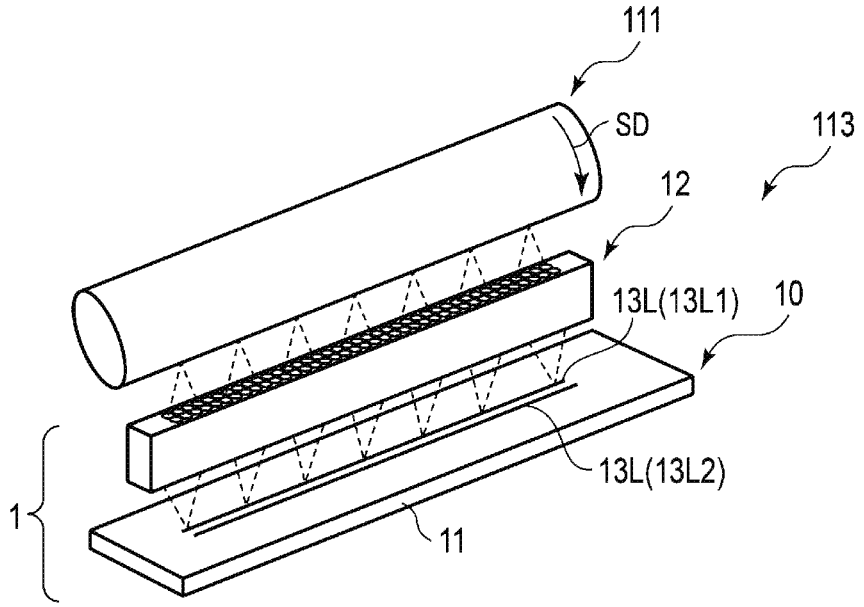
FIG. 2 is a perspective view showing a basic configuration of a photoreceptor drum and an exposure device shown in FIG. 1.

FIG. 2 is a perspective view showing the basic configuration of the photoreceptor drum 111 and the exposure device 113 shown in FIG. 1.

The exposure device 113 has the print head 1 that exposes the photoreceptor drum 111 to form a latent image on the photoreceptor drum 111. The print head 1 is arranged so as to face the photoreceptor drum 111.

The photoreceptor drum 111 rotates in a direction of an arrow shown in FIG. 2. Hereinafter, the rotation direction of the photoreceptor drum 111 is referred to as a sub-scanning direction SD. In addition, a direction perpendicular to the rotation direction of the photoreceptor drum 111, that is, a direction parallel to the rotation axis of the photoreceptor drum 111 is referred to as a longitudinal direction or a main scanning direction MD.

The photoreceptor drum 111 is uniformly charged by a charging device and exposed by light from the print head 1 of the exposure device 113 to lower the potential in the exposed portion thereof. That is, by controlling light emission and non-light emission of the print head 1, an electrostatic latent image is formed on the photoreceptor drum 111.

The print head 1 includes a light emitting unit 10. The light emitting unit 10 includes a transparent substrate 11. For example, the transparent substrate 11 is a glass substrate which transmits light. The transparent substrate 11 is formed with high surface accuracy. On the transparent substrate 11, one or more light emitting element arrays 13L are provided. Each light emitting element array 13L has a plurality of light emitting elements. Each light emitting element array 13L is arranged in parallel to the rotation axis of the photoreceptor drum 111. The light emitting element is formed by, for example, an LED. Alternatively, the light emitting element may be formed by, for example, an organic EL (OLED).

The print head 1 also includes a rod lens array 12. The rod lens array 12 is arranged between the light emitting unit 10 and the photoreceptor drum 111. Specifically, the rod lens array 12 is arranged between the light emitting element array 13L and the photoreceptor drum 111. The rod lens array 12 is arranged in parallel to the rotation axis of the photoreceptor drum 111. The rod lens array 12 condenses the light emitted from the light emitting element array 13L of the light emitting unit 10 on the photoreceptor drum 111.

The print head 1 includes, for example, two light emitting element arrays 13L (a first light emitting element array 13L1 and a second light emitting element array 13L2). In the embodiment, the example in which the print head 1 includes two light emitting element arrays 13L is described, but the embodiment is not limited. For example, the print head 1 may include one light emitting element array 13L.

Figure 3:
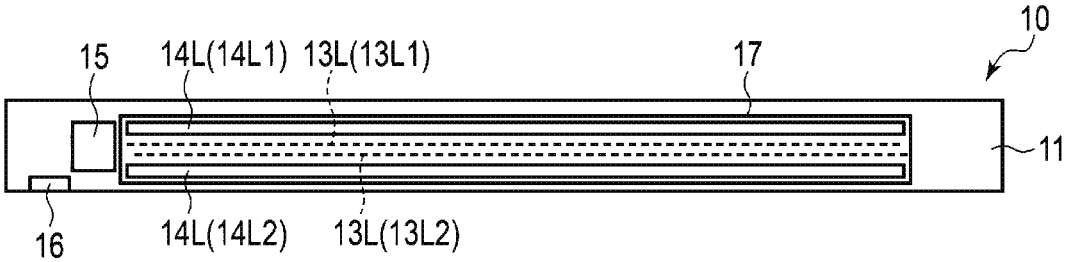
FIG. 3 is a view showing an example of a print head shown in FIG. 2.

FIG. 3 is a view showing an example of the transparent substrate constituting the print head shown in FIG. 2. As shown in FIG. 3, the two light emitting element arrays 13L (the first light emitting element array 13L1 and the second light emitting element array 13L2) are provided along the longitudinal direction of the transparent substrate 11 at the central portion on the transparent substrate 11. In the vicinity of the light emitting element arrays 13L (the first light emitting element array 13L1 and the second light emitting element array 13L2), a drive circuit array 14L (a first drive circuit array 14L1 and a second drive circuit array 14L2) for driving (light-emitting) each light emitting element is formed.

As shown in FIG. 3, for example, the drive circuit array 14L is arranged on both sides of the two light emitting element arrays 13L. The drive circuit array 14L may be arranged on one side of the two light emitting element arrays 13L. The light emitting element array 13L and the drive circuit array 14L are covered with a transparent cover 17 so as not to be exposed to the outside air.

In an end portion of the transparent substrate 11, an integrated circuit (IC) 15 is arranged. In addition, the transparent substrate 11 includes a connector 16. The connector 16 is electrically connected to the print head 1 and the control system of the image forming apparatus. This connection enables power supply, head control, and image data transfer. When it is difficult to mount the connector 16 on the transparent substrate 11, a flexible printed circuit (FPC) may be connected to the transparent substrate 11, and electrical connection with the control system may be achieved through the FPC.

Figure 4:
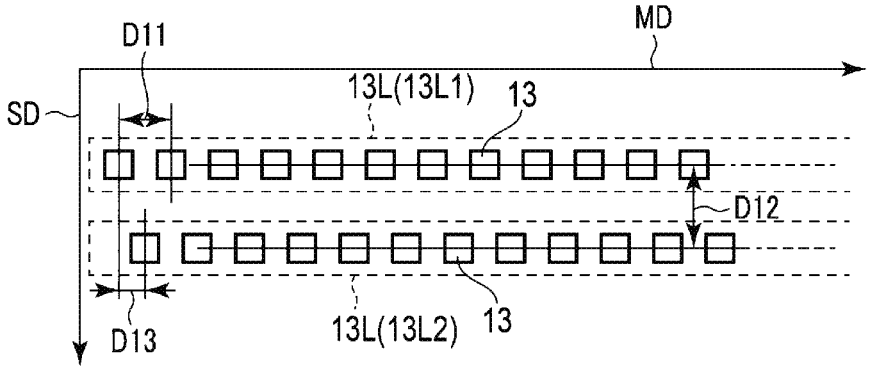
FIG. 4 is a view showing a light emitting element array on a transparent substrate of the print head shown in FIG. 3.

FIG. 4 is a view showing an example of the light emitting element arrays (two array head) shown in FIG. 3. As shown in FIG. 4, each light emitting element array 13L includes a plurality of light emitting elements 13 aligned along the main scanning direction MD. That is, the alignment direction of the plurality of light emitting elements 13 forming the first light emitting element array 13L1 and the arrangement direction of the plurality of light emitting elements 13 forming the second light emitting element array 13L2 are parallel to the main scanning direction MD.

The light emitting element 13 has a square size of 20 μm, for example. Both the light emitting elements 13 of the first light emitting element array 13L1 and the light emitting elements 13 of the second light emitting element array 13L2 are arranged at a predetermined arrangement interval D11 along the main scanning direction MD. The arrangement interval D11 of the light emitting elements 13 is about 42.3 μm, for example, with a resolution of 600 dpi.

The first light emitting element array 13L1 and the second light emitting element array 13L2 are arranged at a distance D12 with respect to the sub-scanning direction SD. Further, each light emitting element 13 forming the first light emitting element array 13L1 and each light emitting element 13 forming the second light emitting element array 13L2 are arranged to be shifted by a predetermined pitch D13 with respect to the main scanning direction MD. For example, the predetermined pitch D13 is ½ of the arrangement interval D11. Thus, the two light emitting element arrays 13L are arranged in a staggered manner.

When the light emitting elements of the first light emitting element array 13L1 and the light emitting elements of the second light emitting element array 13L2 emit light at the same timing, a staggered exposure pattern is formed on the photoreceptor drum 111. Here, for convenience, the upstream side light emitting element array 13L with respect to a moving direction of the photoreceptor drum 111 is referred to as a first light emitting element array 13L1, and the downstream side light emitting element array 13L is referred to as a second light emitting element array 13L2. A control unit that controls an image forming operation causes the first light emitting element array 13L1 and the second light emitting element array 13L2 to emit light at different timings according to the moving speed of the photoreceptor drum 111 and the distance D12. That is, the control unit delays the light emission timing of the second light emitting element array 13L2 with respect to the first light emitting element array 13L1 for a predetermined time according to the moving speed of the photoreceptor drum 111 and the distance D12. In other words, the control unit outputs first light emitting element image data to the first light emitting element array 13L1 and second light emitting element image data to the second light emitting element array 13L2 at different timings according to the moving speed of the photoreceptor drum 111 and the distance D12. Here, the first light emitting element image data and the second light emitting element image data correspond to the image data for one line in the main scanning direction. Thus, a latent image is formed on the photoreceptor drum with a resolution of 1200 dpi.

In this manner, the control unit can increase image density by controlling the light emission timing (image data transfer timing) of the plurality of light emitting element arrays 13L. In the case of the two light emitting element arrays 13L, it is possible to increase the density of the image by twice the density of the light emitting elements 13 per array, and in the case of n (n≥3, n: integer) light emitting element arrays 13L, it is possible to increase the density of the image by n times the density of the light emitting elements 13 per array.

Figure 5:
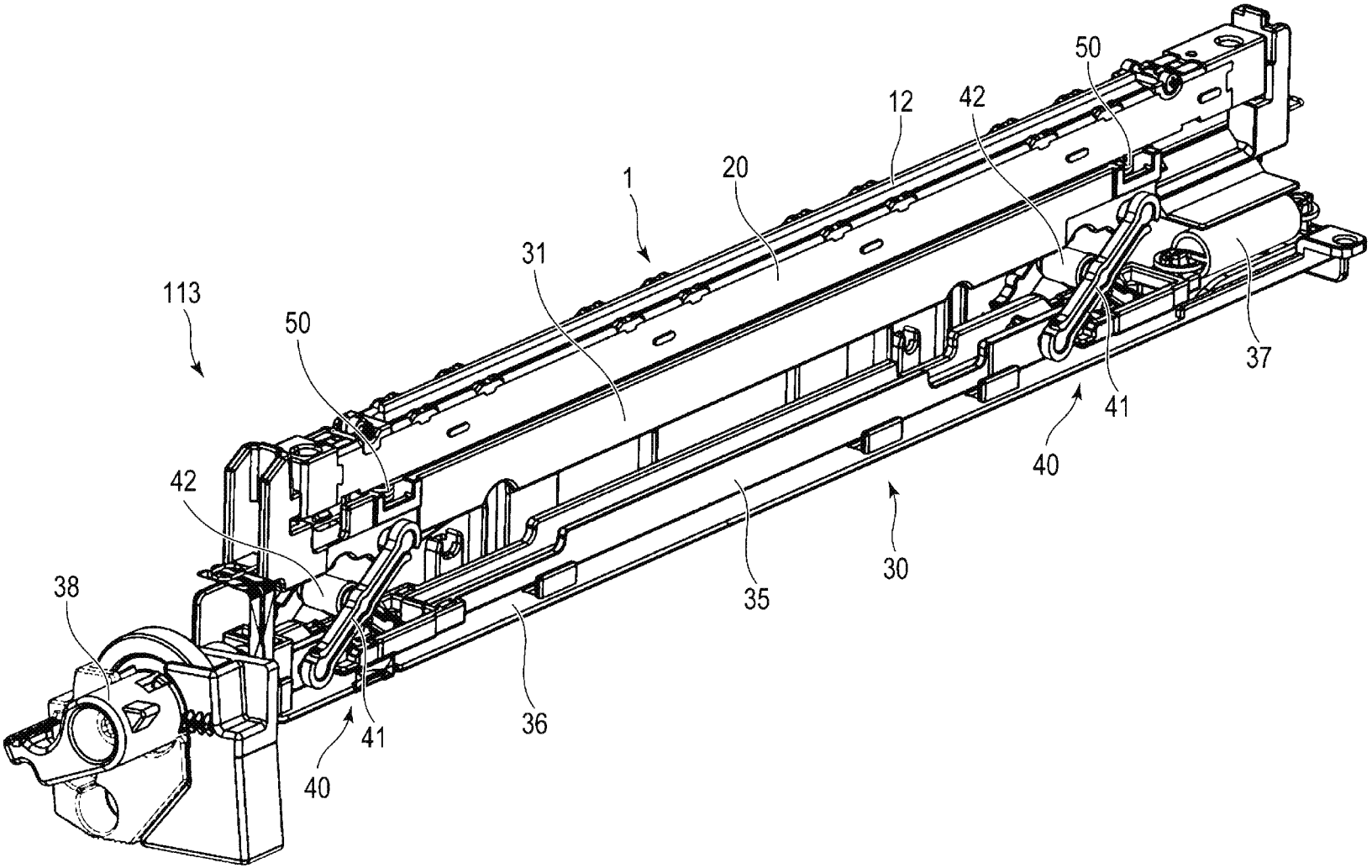
FIG. 5 is a perspective view showing the exposure device shown in FIGS. 1 and 2.

FIG. 5 is a perspective view showing the exposure device shown in FIGS. 1 and 2. The exposure device 113 has the print head 1 shown in FIG. 2. The exposure device 113 is arranged inside the image forming apparatus 100 so that the longitudinal direction of the print head 1 extends in the front-rear direction of the image forming apparatus 100.

The print head 1 includes the light emitting unit 10 and the rod lens array 12 as described with reference to FIG. 2. Further, the print head 1 includes a holder 20 which holds the light emitting unit 10 and the rod lens array 12 in addition to these components. The holder 20 has a slit extending in the longitudinal direction and the rod lens array 12 is accommodated and fixed in this slit.

Figure 6:
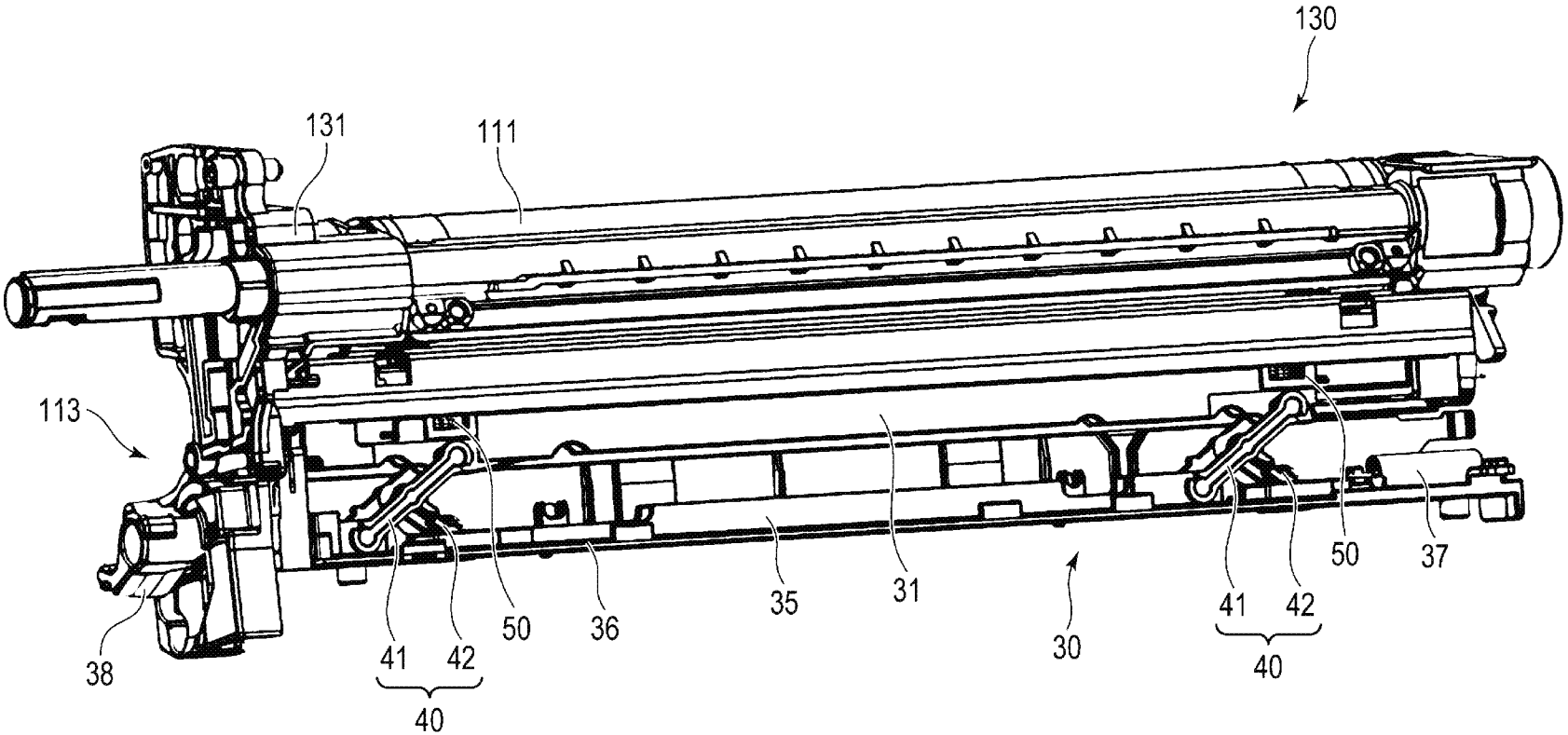
FIG. 6 is a perspective view showing the exposure device shown in FIG. 1 and a photoreceptor unit.
Figure 7:
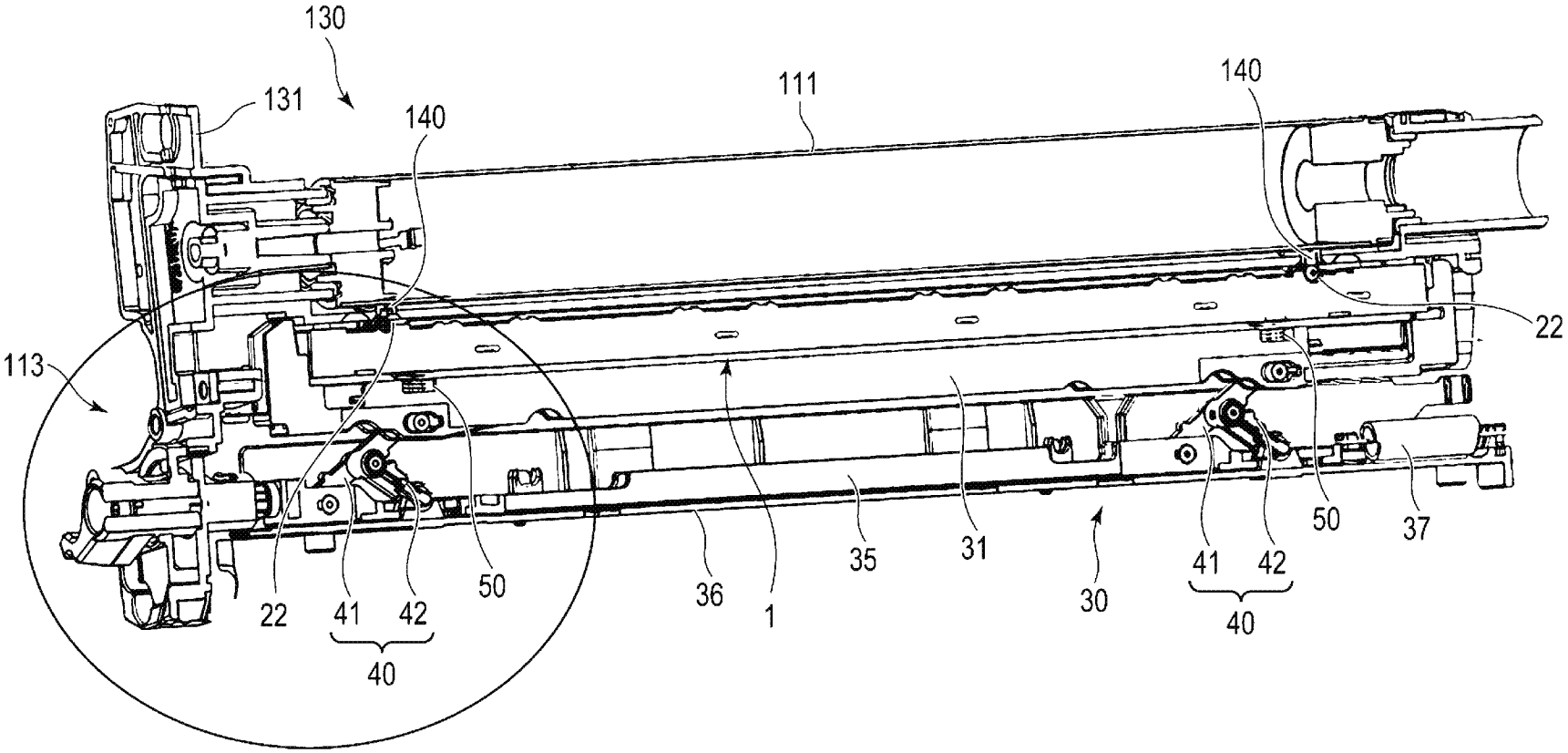
FIG. 7 is a cross-sectional view showing the exposure device and the photoreceptor unit shown in FIG. 6.

FIG. 6 is a perspective view showing the exposure device shown in FIG. 1 and a photoreceptor unit. In addition, FIG. 7 is a cross-sectional view of the exposure device and the photoreceptor unit shown in FIG. 6. As shown in FIGS. 6 and 7, the photoreceptor drum 111 is accommodated in a photoreceptor unit 130. The photoreceptor unit 130 has a case 131. The case 131 holds the photoreceptor drum 111 rotatably.

The photoreceptor unit 130 is attached to the image forming apparatus 100 to be replaceable. For example, the photoreceptor unit 130 is attached to and detached from the image forming apparatus 100 by being inserted into and removed from the front side of the image forming apparatus 100. The photoreceptor unit 130 is mounted on the image forming apparatus 100 so that the photoreceptor drum 111 is parallel to the print head 1 of the exposure device 113.

In order to clean the print head 1 and replace the photoreceptor unit 130, the print head 1 needs to be lifted and lowered so that the print head 1 can about on and separate from the photoreceptor unit 130. Therefore, as shown in FIGS. 5 to 7, the exposure device 113 has a lifting mechanism 30 that lifts or lowers the print head 1. The lifting mechanism 30 has a function of lifting the print head 1 and a function of lowering the print head 1. Here, lifting the print head 1 means that the print head 1 approaches the photoreceptor drum 111. In addition, lowering the print head 1 means that the print head 1 is separated from the photoreceptor drum 111.

Here, the photoreceptor drum 111 naturally refers to a photoreceptor drum accommodated in the photoreceptor unit 130 mounted on the image forming apparatus 100. In the following description, the photoreceptor drum 111 means a photoreceptor drum in the photoreceptor unit 130 mounted on the image forming apparatus 100.

The lifting mechanism 30 has a liftable lifting holder 31 that holds the print head 1. The lifting holder 31 is movable so as to approach the photoreceptor drum 111 or separate from the photoreceptor drum 111.

The lifting mechanism 30 also has a lifting slider 35 that is movable in the longitudinal direction, a guide 36 that guides the lifting slider 35, a lifting spring 37 that biases the lifting slider 35, and a lifting lever 38 for moving the lifting slider 35.

The lifting slider 35 is supported by the guide 36 to be movable in the longitudinal direction. One end of the lifting spring 37 is attached to the guide 36 and the other end thereof is attached to the lifting slider 35. The lifting spring 37 biases the lifting slider 35 toward the lifting lever 38.

The lifting lever 38 has a structure that moves the lifting slider 35 against the biasing force of the lifting spring 37 by a rotating operation thereof.

The lifting lever 38 has, for example, a pin that moves in the longitudinal direction of the guide 36 according to the rotation thereof. By pushing the pin of the lifting lever 38 toward the lifting spring 37, the lifting slider 35 is moved toward the lifting spring 37 against the biasing force of the lifting spring 37. In contrast, by pulling the pushed pin of the lifting lever 38, the lifting slider 35 is moved toward the lifting lever 38 by the biasing force of the lifting spring 37.

The lifting mechanism 30 further has a pair of link mechanisms 40 that connect the lifting holder 31 and the lifting slider 35. The link mechanism 40 is a Scott Russell type link mechanism. The Scott Russell type link mechanism 40 converts the movement of the lifting slider 35 in the longitudinal direction into the movement of the lifting holder 31 in a direction perpendicular to the longitudinal direction.

The link mechanism 40 has a first link 41 and a second ink 42. The first link 41 is longer than the second link 42. One end of the first link 41 is rotatably connected to the lifting slider 35. The other end of the first link 41 is rotatably connected to the lifting holder 31. For example, the other end of the first link 41 is engaged with the long hole of the lifting holder 31. One end of the second link 42 is rotatably connected to the guide 36. One end of the second link 42 is rotatably connected to the central portion of the first link 41.

According to the movement of the lifting slider 35 in a direction from the lifting lever 38 to the lifting spring 37, the other end of the first link 41, that is, the connection portion with the lifting holder 31 is lifted, that is, approaches the photoreceptor drum 111. As a result, the lifting holder 31 is lifted, that is, approaches the photoreceptor drum 111.

In contrast, according to the movement of the lifting slider 35 in a direction from the lifting spring 37 to the lifting lever 38, the other end of the first link 41, that is, the connection portion with the lifting holder 31 is lowered, that is, separated from the photoreceptor drum 111. As a result, the lifting holder 31 is lowered, that is, separated from the photoreceptor drum 111. The direction of lifting and lowering of the lifting holder 31, that is, the direction of approach and separation of the lifting holder, is substantially perpendicular to the moving direction of the lifting slider 35.

The lifting mechanism 30 further has a biasing member that biases the print head 1 toward the photoreceptor drum 111, for example, a pair of coil springs 50. The coil spring 50 is arranged between the print head 1 and the lifting holder 31. That is, the coil spring 50 is arranged between a head holder 20 and the lifting holder 31.

Figure 8:
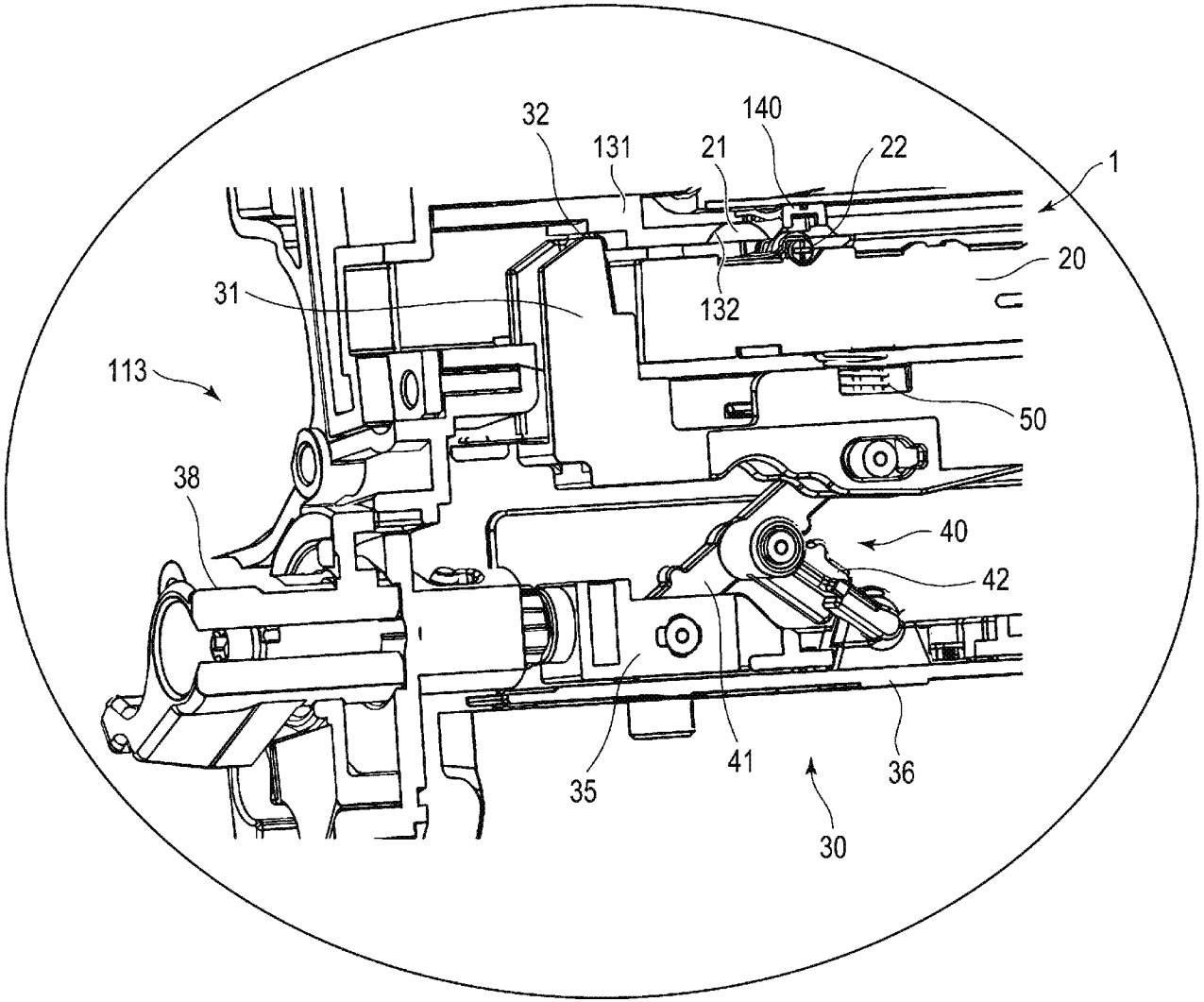
FIG. 8 is a view showing a part surrounded by an ellipse shown in FIG. 7 in an enlarged manner.

FIG. 8 is a view showing a part surrounded by an ellipse shown in FIG. 7 in an enlarged manner. As shown in FIG. 8, the head holder 20 has a dowel 21 protruding toward the photoreceptor unit 130 attached to the image forming apparatus 100. In addition, a cleaner case 131 has a dowel hole 132 for receiving the dowel 21. The dowel hole 132 has a size that allows the dowel 21 to be just fitted.

The dowel 21 of the head holder 20 and the dowel hole 132 of the cleaner case 131 are configured to determine the position of the print head 1 with respect to the cleaner case 131 in a direction perpendicular to the lifting direction of the print head 1 by the lifting mechanism 30 by fitting the dowel 21 into the dowel hole 132 of the cleaner case 131 when the print head 1 is lifted.

That is, by the dowel 21 of the head holder 20 and the dowel hole 132 of the cleaner case 131, the position of the print head 1 with respect to the cleaner case 131 is determined for the position of the print head 1 in the longitudinal direction and the position of the photoreceptor drum 111 in a direction perpendicular to both the diameter direction and the longitudinal direction.

The head holder 20 has a pair of head position determining units 22 at both ends in the longitudinal direction. The pair of head position determining units 22 respectively abut on a pair of gap spacers 140 arranged between the print head 1 and the photoreceptor drum 111 when the print head 1 is lifted, that is, the print head 1 approaches the photoreceptor drum 111. The head position determining unit 22 is configured by, for example, a cam.

The lifting holder 31 has a pair of lifting holder position determining units 32 at both ends in the longitudinal direction. The pair of lifting holder position determining units 32 respectively abut on the cleaner case 131 holding the photoreceptor drum 111 when the print head 1 is lifted, that is, the print head 1 approaches the photoreceptor drum 111.

The head position determining units 22 of the head holder 20 and the lifting holder position determining units 32 of the lifting holder 31 are provided for determining the positions of the print head 1 with respect to the photoreceptor drum 111 when the print head 1 is lifted to the maximum. For example, the head position determining units 22 and the lifting holder position determining units 32 are provided for determining a distance between the print head 1 and the photoreceptor drum 111, in other words, for accurately arranging a focal position of the print head 1 on the surface of the photoreceptor drum 111.

Thus, the pair of lifting holder position determining units 32 determines the position of the print head 1 with respect to the photoreceptor drum 111. For example, the pair of lifting holder position determining units 32 determines a distance from the photoreceptor drum 111 to the print head 1.

The lifting holder position determining units 32 and the head position determining units 22 are configured such that, when the print head 1 is lifted, the head position determining units 22 of the head holder 20 abut on the gap spacers 140 before the lifting holder position determining units 32 of the lifting holder 31 abut on the cleaner case 131.

The coil spring 50 arranged between the head holder 20 and the lifting holder 31 applies a predetermined abutting load with respect to the photoreceptor drum 111 to the print head 1 when the print head 1 is lifted to the maximum, in other words, in a state in which the lifting holder position determining units 32 of the lifting holder 31 abut on the cleaner case 131.

The stroke of the lifting mechanism 30 is larger than the maximum distance between the print head 1 and the photoreceptor drum 111. Here, the stroke of the lifting mechanism 30 means a distance in which the print head 1 is moved by the lifting mechanism 30 in a situation where the photoreceptor drum 111 does not exist, in other words, in a situation where the movement of the print head 1 is not obstructed by anything. The maximum distance between the print head 1 and the photoreceptor drum 111 means a distance between the print head 1 and the photoreceptor drum 111 in the lowest state of the print head 1, in other words, in a state in which the print head 1 is most distant from the photoreceptor drum 111.

Figure 9:
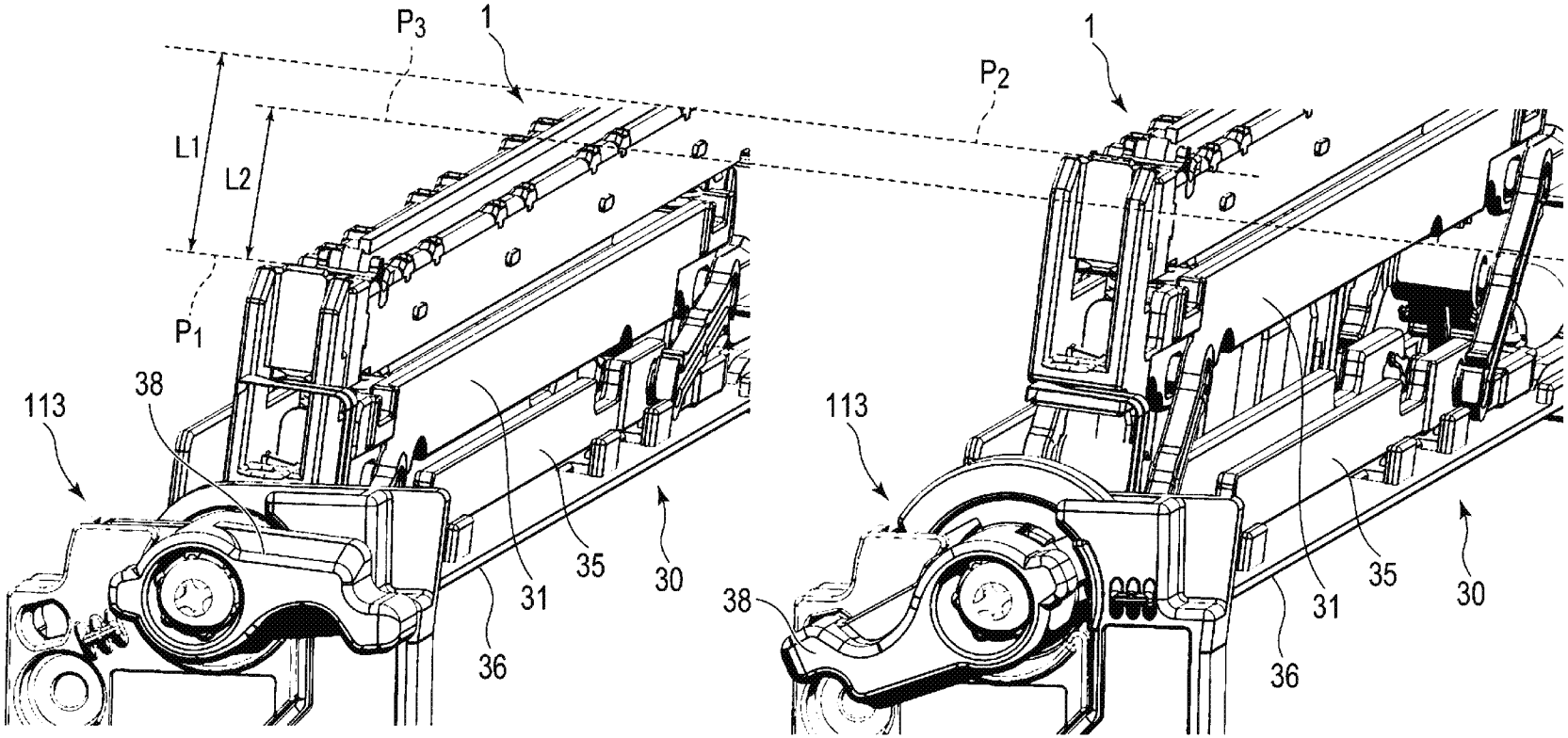
FIG. 9 is a view showing the exposure device in which a lifting holder is at a lowest position and the exposure device in which the lifting holder is at a highest position in a situation where the photoreceptor drum does not exist.

FIG. 9 is a view showing the exposure device 113 in which the lifting holder 31 is at the lowest position and the exposure device 113 in which the lifting holder 31 is at the highest position in a situation where the photoreceptor drum 111 does not exist. In FIG. 9, the exposure device 113 in which the lifting holder 31 is at the lowest position is shown on the left side and the exposure device 113 in which the lifting holder 31 is at the highest position is shown on the right side.

In addition, the position of the lifting holder position determining units 32 of the lifting holder 31 at the lowest position is indicated by P1, and the position of the lifting holder position determining units 32 of the lifting holder 31 at the highest position is indicated by P2. Further, the position of the lifting holder position determining units 32 of the lifting holder 31 in a state in which the lifting holder 31 actually abuts on the cleaner case 131 is indicated by P3. Here, the positions P1, P2, and P3 mean the positions in the lifting direction of the lifting holder 31 by the lifting mechanism 30.

The stroke of the lifting mechanism 30 is indicated by a distance L1 between the position P1 and the position P2. In addition, the maximum distance between the print head 1 and the photoreceptor drum 111 is indicated by a distance L2 between the position P1 and the position P3.

Since the stroke of the lifting mechanism 30 is larger than the maximum distance between the print head 1 and the photoreceptor drum 111, even when the photoreceptor drum 111 is not arranged in parallel to the print head 1 due to the tolerance of the photoreceptor unit 130, the lifting holder 31 is reliably arranged in parallel to the photoreceptor drum 111.

Figure 10:
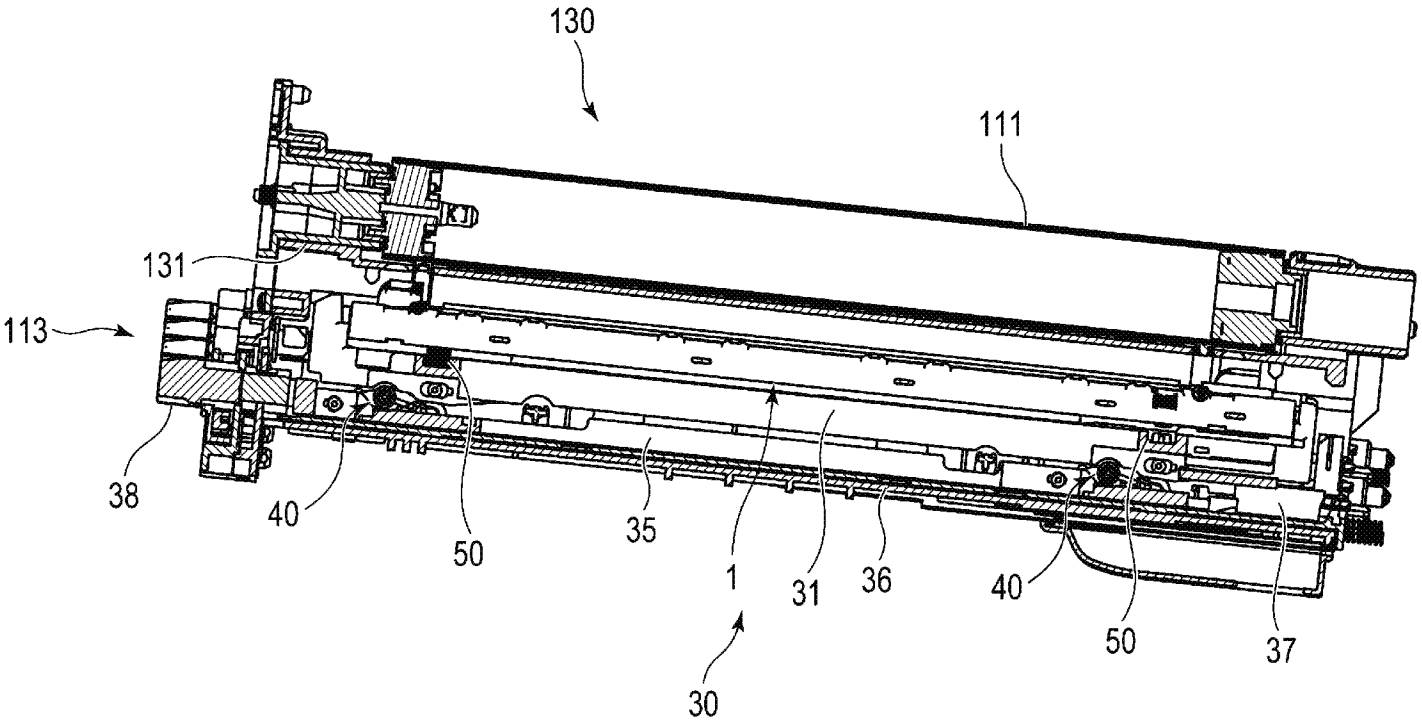
FIG. 10 is a cross-sectional view of the exposure device and the photoreceptor unit in a state in which the lifting holder and a cleaner case are separated from each other.
Figure 11:
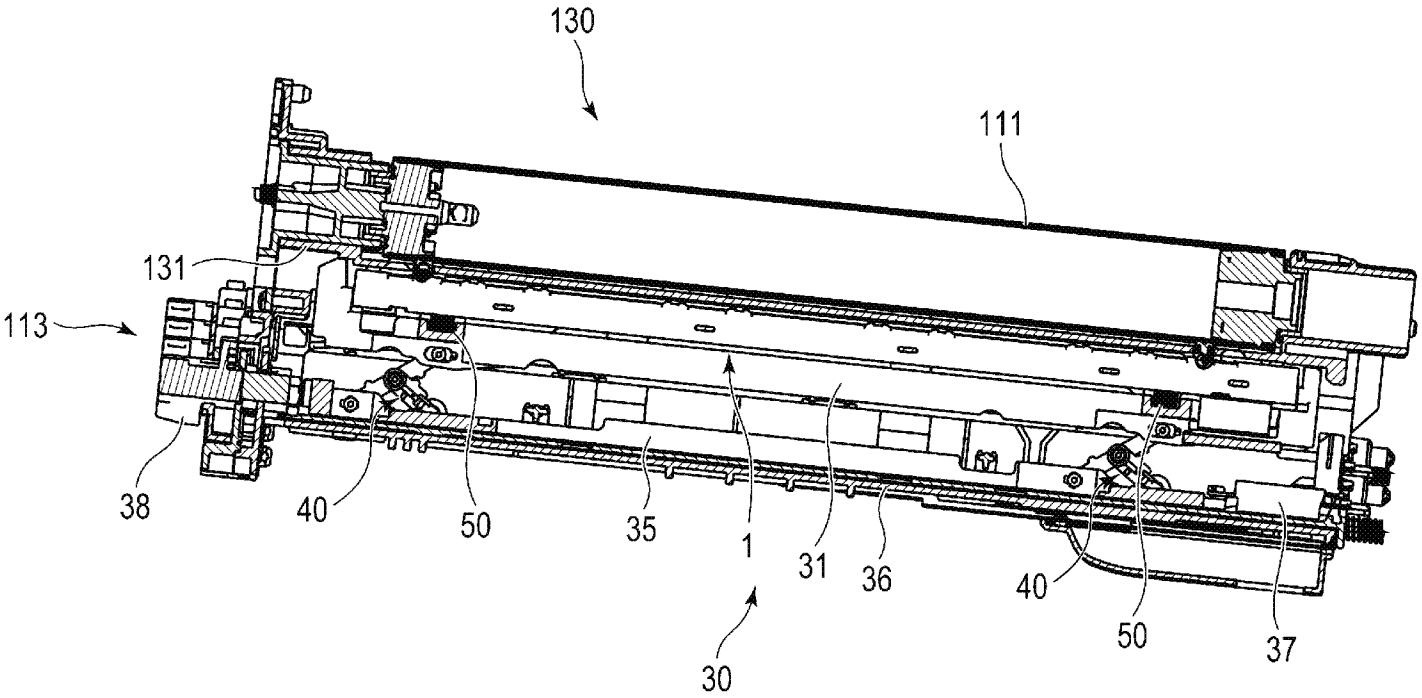
FIG. 11 is a cross-sectional view of the exposure device and the photoreceptor unit in a state in which the lifting holder and the cleaner case abut on each other.

FIG. 10 is a cross-sectional view of the exposure device 113 and the photoreceptor unit 130 in a state in which the lifting holder 31 and the cleaner case 131 are separated from each other. In addition, FIG. 11 is a cross-sectional view of the exposure device 113 and the photoreceptor unit 130 in a state in which the lifting holder 31 and the cleaner case 131 abut on each other.

As shown in FIG. 10, in a state in which the lifting holder 31 and the cleaner case 131 are separated from each other, the photoreceptor drum 111 is not arranged in parallel to the print head 1. In this case, when the lifting mechanism 30 is lifted by the lifting holder 31, one lifting holder position determining unit 32 of the lifting holder 31 first abuts on the cleaner case 131. However, since the lifting holder 31 is then continuously lifted by the lifting mechanism 30, the other lifting holder position determining unit 32 of the lifting holder 31 also reliably abuts on the cleaner case 131. As a result, as shown in FIG. 11, the lifting holder 31 is reliably arranged in parallel to the photoreceptor drum 111.

As described above, in the exposure device 113 of the embodiment, the print head 1, the lifting holder 31, and the coil spring 50 are lifted and lowered together. In a configuration in which only the print head that is generally widely used is lifted and lowered, due to the tolerance of the dimensions of all the components forming the lifting mechanism and warping of the tray surface with the lifting mechanism attached and inclination of the print head that occurs during lifting and lowering, there is a possibility that defects such as the print head not accurately abutting on the gap spacer and a variation in the squeeze amount of the coil spring may be generated.

However, since the exposure device 113 of the embodiment has a configuration in which the print head 1, the lifting holder 31, and the coil spring 50 are lifted and lowered together, the exposure device has the following advantages.

The abutting load of the print head 1 with respect to the photoreceptor drum 111 is determined by the coil spring 50 arranged between the print head 1 and the lifting holder 31. As described above, when the lifting holder 31 is lifted to the maximum by the lifting mechanism 30, the lifting holder 31 is reliably arranged in parallel to the photoreceptor drum 111. Therefore, the abutting load of the print head 1 at both end portions in the longitudinal direction is substantially equal. That is, the abutting load of the print head 1 does not substantially have a variation at both end portions in the longitudinal direction. Further, as the abutting load of the print head 1, a predetermined abutting load equal to or more than the lower limit value is obtained. Thus, the print head 1 abuts on the gap spacer 140 with a predetermined abutting load having no variation at both end portions in the longitudinal direction.

The inclination of the print head 1 with respect to the photoreceptor drum 111 is a factor that deteriorates the quality of an image formed by the image forming apparatus 100. However, since the print head 1 is reliably arranged in parallel to the photoreceptor drum 111 in the exposure device 113 of the embodiment, such image quality deterioration is prevented.

In addition, the variation in the abutting load of the print head 1 with respect to the photoreceptor drum 111 is a factor that causes the photoreceptor drum 111 to wear unevenly, and causes variation in the focal position of the print head 1 in the longitudinal direction position. However, since there is no variation in the abutting load of the print head 1 in the exposure device 113 of the embodiment, the generation of variation in the focal position of the print head 1 is prevented.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An exposure device of an image forming apparatus comprising:

a print head that exposes a photoreceptor to form a latent image on the photoreceptor;

a lifting mechanism that lifts or lowers the print head relative to the photoreceptor, wherein the lifting mechanism has a lifting holder that holds the print head and is moveable with respect to the photoreceptor, and wherein the lifting mechanism has a lifting spring with a biasing force that facilitates separating the print head from the photoreceptor; and a biasing member that biases the print head toward the photoreceptor, the biasing member provided between the print head and the lifting holder, wherein the print head has a light emitting unit that emits light, a lens that condenses light emitted from the light emitting unit on the photoreceptor, and a head holder that holds the light emitting unit and the lens, the head holder has a head position determining unit that abuts on a gap spacer provided between the print head and the photoreceptor and determines a position of the print head, the lifting holder has a lifting holder position determining unit that abuts on a case holding the photoreceptor and determines a position of the lifting holder, and the lifting holder position determining unit and the head position determining unit are configured such that when the print head is lifted, before the lifting holder position determining unit abuts on the case, the head position determining unit abuts on the gap spacer.

2. The device according to claim 1, wherein the biasing member applies a predetermined abutting load with respect to the photoreceptor to the print head in a state in which the lifting holder position determining unit of the lifting holder abuts on the case.

3. The device according to claim 1, wherein a stroke of the lifting mechanism is larger than a distance between the print head and the photoreceptor at a lowest position of the print head relative to the photoreceptor.

4. The device according to claim 1, wherein the print head comprises a light emitting diode.

5. The device according to claim 1, wherein the print head comprises an organic light emitting diode.

6. The device according to claim 1, wherein the print head comprises a rod lens array.

7. The device according to claim 1, wherein the print head comprises two light emitting element arrays.

8. The device according to claim 1, wherein the biasing member comprises a par of coiled springs.

9. An image forming apparatus, comprising:

a paper holder;

a fixing unit;

an exposure device comprising:

a print head that exposes a photoreceptor to form a latent image on the photoreceptor;

a lifting mechanism that lifts or lowers the print head relative to the photoreceptor, wherein the lifting mechanism has a lifting holder that holds the print head and is moveable with respect to the photoreceptor, and wherein the lifting mechanism has a lifting spring with a biasing force that facilitates separating the print head from the photoreceptor; and a biasing member that biases the print head toward the photoreceptor, the biasing member provided between the print head and the lifting holder, wherein the print head has a light emitting unit that emits light, a lens that condenses light emitted from the light emitting unit on the photoreceptor, and a head holder that holds the light emitting unit and the lens, the head holder has a head position determining unit that abuts on a gap spacer provided between the print head and the photoreceptor and determines a position of the print head, the lifting holder has a lifting holder position determining unit that abuts on a ease holding the photoreceptor and determines a position of the lifting holder, and the lifting holder position determining unit and the head position determining unit are configured such that when the print head is lifted, before the lifting holder position determining unit abuts on the case, the head position determining unit abuts on the gap spacer.

10. The image forming apparatus according to claim 9, wherein the biasing member applies a predetermined abutting load with respect to the photoreceptor to the print head in a state in which the lifting holder position determining unit of the lifting holder abuts on the case.

11. The image forming apparatus according to claim 9, wherein a stroke of the lifting mechanism is larger than a distance between the print head and the photoreceptor at a lowest position of the print head relative to the photoreceptor.

12. The image forming apparatus according to claim 9, wherein the print head comprises at least one of a light emitting diode and an organic light emitting diode.

13. The image forming apparatus according to claim 9, wherein the print head comprises a rod lens array.

14. The image forming apparatus according to claim 9, wherein the print head comprises two light emitting element arrays.

15. The image forming apparatus according to claim 9, wherein the biasing member comprises a par of coiled springs.

16. A color image forming apparatus, comprising:

a paper holder;

a fixing unit;

a plurality of exposure devices, each exposure device comprising:

a print head that exposes a photoreceptor to form a latent image on the photoreceptor;

a lifting mechanism that lifts or lowers the print head relative to the photoreceptor, wherein the lifting mechanism has a lifting holder that holds the print head and is moveable with respect to the photoreceptor, and wherein the lifting mechanism has a lifting spring with a biasing force that facilitates separating the print head from the photoreceptor; and a biasing member that biases the print head toward the photoreceptor, the biasing member provided between the print head and the lifting holder, wherein the print head has a light emitting unit that emits light, a lens that condenses light emitted from the light emitting unit on the photoreceptor, and a head holder that holds the light emitting unit and the lens, the head holder has a head position determining unit that abuts on a gap spacer provided between the print head and the photoreceptor and determines a position of the print head, the lifting holder has a lifting holder position determining unit that abuts on a case holding the photoreceptor and determines a position of the lifting holder, and the lifting holder position determining unit and the head position determining unit are configured such that when the print head is lifted, before the lifting holder position determining unit abuts on the case, the head position determining unit abuts on the gap spacer.

17. The color image forming apparatus according to claim 16, wherein the biasing member applies a predetermined abutting load with respect to the photoreceptor to the print head in a state in which the lifting holder position determining unit of the lifting holder abuts on the case.

* * * * *